US006638182B2

(12) United States Patent
Kosmatka

(10) Patent No.: US 6,638,182 B2
(45) **Date of Patent: *Oct. 28, 2003**

(54) GOLF CLUB HEAD WITH COATED STRIKING PLATE

(75) Inventor: John B. Kosmatka, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/064,664

(22) Filed: Aug. 5, 2002

(65) Prior Publication Data

US 2002/0187852 A1 Dec. 12, 2002

Related U.S. Application Data

(63) Continuation of application No. 09/678,942, filed on Oct. 3, 2000, now Pat. No. 6,428,427.

(51) Int. Cl.[7] ..... A63B 53/04
(52) U.S. Cl. ..... 473/331; 473/345; 473/349
(58) Field of Search ..... 473/324, 342, 473/330, 331, 345, 346, 349, 290, 291, 292, 329, 332

(56) References Cited

U.S. PATENT DOCUMENTS 4,792,140 A * 12/1988 Yamaguchi
5,141,231 A * 8/1992 Cox
5,299,807 A * 4/1994 Hutin
5,377,986 A * 1/1995 Viollaz
5,405,136 A * 4/1995 Hardman
5,423,535 A * 6/1995 Shaw
5,509,660 A * 4/1996 Elmer
5,573,467 A * 11/1996 Chou
5,709,617 A * 1/1998 Nishimura
5,839,975 A * 11/1998 Lundberg
5,971,867 A * 10/1999 Galy
6,165,081 A * 12/2000 Chou
6,428,427 B1 * 8/2002 Kosmatka

* cited by examiner

*Primary Examiner*—Sebastiano Passaniti
(74) *Attorney, Agent, or Firm*—Michael A. Catania; Elaine H. Lo

(57) ABSTRACT

A golf club head (20) having a thin striking plate (30) with a smooth exterior surface and a thin layer (35) disposed on the exterior surface (53). The thin layer (35) has a plurality of scorelines (75) that absorb the shock during impact with a golf ball. The striking plate (30) has a thickness in the range of 0.010 inch to 0.200 inch, and the thin layer (35) has a thickness in the range of 0.003 inch to 0.050 inch. The striking plate (30) may have a uniform thickness or a variable thickness.

3 Claims, 6 Drawing Sheets

GOLF CLUB HEAD WITH COATED STRIKING PLATE

CROSS REFERENCES TO RELATED APPLICATIONS

This Application is a continuation application of U.S. patent application Ser. No. 09/678,942, filed on Oct. 3, 2000, now U.S. Pat. No. 6,428,427.

FEDERAL RESEARCH STATEMENT

[Not Applicable]

BACKGROUND OF INVENTION

1. Field of the Invention

The present invention relates to a golf club having a relatively thin striking plate. More specifically, the present invention relates to a golf club having a thin striking plate with a coating on the exterior surface of the striking plate.

2. Description of the Related Art

Present golf clubs have repositioned weight in order to lower the center of gravity for better performance. This repositioning of weight has for the most part attempted to thin the crown and striking plate of the golf club while precisely placing the weight in the sole of the golf club. However, thinning the striking plate too much may lead to failure of the golf club.

When the striking plate impacts a golf ball during a swing, large impact forces (in excess of 2000 pounds) are produced thereby loading the striking plate. In the relatively thin striking plates of hollow metal woods and cavity-back irons, these forces tend to produce large internal stresses in the striking plate. These internal stresses often cause catastrophic material cracking which leads to failure of the club head.

Computational and experimental studies on hollow metal woods and cavity-backed irons have demonstrated that such catastrophic material cracking most often occurs at impact points on the striking plate. These impact points require added strength to prevent club head failure.

In designing golf club heads, the striking plate must be structurally adequate to withstand large repeated forces such as those associated with impacting a golf ball at high speeds. Such structural adequacy may be achieved by increasing the striking plate stiffness so that the stress levels are below the critical stress levels of the material used in the striking plate. Typically, for metal woods, the striking plates are stiffened by uniformly increasing the thickness of the striking plate and/or by adding one or more ribs to the interior surface of the striking plate.

Uniformly increasing the thickness of the striking plate portion typically requires the addition of large amounts of material to adequately reduce the stress sufficient to prevent impact and/or fatigue cracking. However, the addition of such a large amount of material to a striking plate generally adversely affects the performance of the golf club.

One of the first patents to disclose variable face thickness was U.S. Pat. No. 5,318,300 to Schmidt et al., for a Metal Wood Golf Club With Variable Faceplate Thickness which was filed on Nov. 2, 1992. Schmidt et al discloses thickening the faceplate to prevent cracking.

A further disclosure of variable face thickness is disclosed in U.S. Pat. No. 5,830,084 to Kosmatka for a Contoured Golf Club Face which was filed on Oct. 23, 1996. Kosmatka addresses contouring the face to thicken certain regions while thinning other regions depending on the stress load experienced by such regions. Kosmatka also discloses a method for designing a face plate according to measured stress levels experienced during impact with a golf ball. Kosmatka, U.S. Pat. No. 5,971,868 for a Contoured Back Surface Of Golf Club Face, filed on Nov. 18, 1997, discloses similar contouring for an iron.

A more recent disclosure is Noble et al., U.S. Pat. No. 5,954,596, for a Golf Club Head With Reinforced Front Wall, which was filed on Dec. 4, 1997. Noble et al. discloses a face plate with the thickness portion at the geometric center, and gradually decreasing toward the top and bottom, and the sole and heel. The top and bottom ends along a line through geometric center have the same thickness, and the heel and sole ends along a line through geometric center have the same thickness.

Other references make partial disclosure of varying face thickness. One example is FIG. 8 of U.S. Pat. No. 5,505,453 which illustrates an interior surface of a face with a bulging center and decreasing thickness towards the heel and sole ends, similar to Noble et al. Another example is FIGS. 4C and 4D of U.S. Pat. No. 5,346,216 which discloses a bulging center that decreases in thickness toward the heel and sole ends, and the top and bottom end of the face, similar to Noble et al. However, the prior art has failed to design a striking plate or face plate that is thin and reduces scoreline concentration of the initial shock load during impact with a golf ball.

SUMMARY OF INVENTION

The present invention is directed at a golf club head having a thin striking plate that has a smooth exterior surface with a thin layer disposed on the exterior surface. The thin layer has a plurality of scorelines to absorb the initial shock load during impact with a golf ball and to distribute and reduce stress loads in the body of the golf club head.

One aspect of the present invention is a golf club head including a body, a striking plate and a thin layer. The body has a crown, a sole, a heel end, a toe end and a hollow interior. The striking plate is attached to the body. The striking plate has an interior surface facing toward the hollow interior and a smooth exterior surface opposite the interior surface. The striking plate has a thickness range of 0.010 inch to 0.200 inch. The thin layer is disposed on the exterior surface of the striking plate. The thin layer has a thickness of 0.005 inch to 0.100 inch, and can have a plurality of scorelines.

Another aspect of the present invention is a wood-type golf club head having a body and a thin layer. The body has a crown, a sole, a ribbon, a striking plate and a hollow interior. The body is composed of a metal material. The striking plate has an interior surface toward the hollow interior and a smooth exterior surface opposite the interior surface. The striking plate has a thickness range of 0.010 inch to 0.200 inch. The body has a volume of 250 cubic centimeters to 400 cubic centimeters. The thin layer is disposed on the exterior surface of the striking plate. The thin layer has a central impact region composed of a polyurethane material having a Shore D hardness greater than 50 for low friction and low energy loss. The thin layer also has a peripheral impact region composed of a polyurethane material having a Shore D hardness lower than 40 for a high friction coefficient and a high energy loss. The thin layer has a thickness of 0.005 inch to 0.100 inch. The thin layer has a plurality of scorelines thereon. The golf club head has a coefficient of restitution of at least 0.83 under USGA test conditions.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
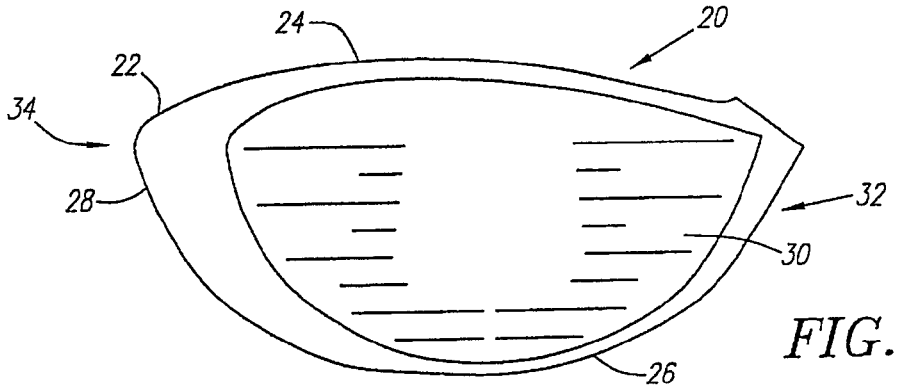
FIG. 1 is a front plan view of a golf club head with the striking plate of the present invention.

As shown in FIGS. 1–8, a golf club head is generally designated 20. The golf club head 20 has a body 22 with a crown 24, a sole 26, a ribbon 28, a striking plate 30, and a thin layer 35 disposed on the striking plate 30. The striking plate 30 generally extends from a heel end 32 to a toe end 34 of the front of the golf club head 20. The body 22 preferably has an internal hosel 36 for receiving the tip end of a shaft, not shown, through an aperture 38. The golf club head has a body 22 that is preferably composed of a metal material such as titanium, titanium alloy, stainless steel, or the like, and is most preferably composed of a forged titanium material. The body 22 preferably has a large volume, ranging from 250 cubic centimeters to 400 cubic centimeters, most preferably 290 cubic centimeters to 350 cubic centimeters. The body 22 preferably weighs no more than 215 grams, and most preferably weighs between 180 and 205 grams. The body 22 has a hollow interior 23.

The striking plate 30 may have a uniform thickness or a variable thickness. The exterior surface 53 of the striking plate is smooth while the interior surface 55 of the striking plate may be uniform or vary in thickness. The exterior surface also has an absence of scorelines since scorelines are stress concentrators during impact with a golf ball. Due to the extremely thin striking plate 30, scorelines would lead to failure of the striking plate 30. The thickness of the striking plate 30 ranges from 0.010 inch to 0.300, preferably from the 0.040 inch to 0.250, and most preferably from 0.060 inch to 0.150 inch. The thickness of the striking plate 30 is greatly determined by the size of the golf club head 20, and the material composition of the striking plate 30. Titanium alloys have a lower density than stainless steel, and thus a titanium alloy striking plate 30 allows for the weight to be distributed elsewhere in the body 22.

The thin layer 35 is attached to the exterior surface 53 of the striking plate 30. The thin layer 35 has a plurality of scorelines 75 thereon. The thin layer 35 absorbs the initial shock load, distributes the stress loads throughout the entire golf club head 20, and reduces the stress load throughout the entire golf club head 20. The thin layer 35 may cover the entire exterior surface 53, or only a portion of the exterior surface 53. The thin layer 35 has a thickness that ranges from 0.003 inch to 0.050 inch, more preferably from 0.005 inch to 0.025 inch, and most preferably 0.010 inch. The overall thickness of the striking plate 30 and the thin layer 35 preferably ranges from 0.020 inch to 0.250 inch, more preferably from 0.050 inch to 0.150 inch, and most preferably is 0.100 inch.

The thin layer 35 is preferably composed of a material that has a lower density than the material of the striking plate 30. The thin layer 35 is preferably composed of a polymer material, a composite material, a lightweight metal material, or the like. Polymer materials that are used for the thin layer 35 include polyurethanes, polyamides, polyimides, polycarbonates, and the like. Lightweight metals that are used for the thin layer 35 include titanium, aluminum, beryllium, magnesium, zirconium alloys, and the like.

Preferably, the striking plate 30 is partitioned into a plurality of regions 40, 42, 44 and 46, defined by lines 41, 43, 45 and 47, each having a different thickness or different thickness range. The striking plate 30 is unitary in construction, and may or may not be composed of the same material of the body 22. The term unitary when used in conjunction with the striking plate 30 means that the striking plate 30 is a single piece and does not have additions to the interior surface 55 such as ribs or weighting members. The thin layer 35 is a separate component from the striking plate 30. A central region 40, defined by dashed line 41, has a base thickness that is preferably the greatest thickness of the regions 40, 42, 44 and 46. The base thickness ranges from 0.200 inch to 0.060 inch, preferably from 0.150 inch to 0.075 inch, and is most preferably within the range of 0.145 inch to 0.090 inch. A transition region 42 has a thickness that ranges between the thickness of the central region 40 and a first peripheral region 44, preferably ranges from 0.150 inch to 0.090 inch, and most preferably ranges from 0.140 inch to 0.080 inch. The first peripheral region 44 has a thickness that ranges from 0.110 inch to 0.040 inch, preferably ranges from 0.105 inch to 0.050 inch, and most preferably ranges from 0.100 inch to 0.075 inch. A second peripheral region 46 preferably is the thinnest region of the striking plate regions 40, 42, 44 and 46. The second peripheral region 46 has a thickness that ranges from 0.085 inch to 0.010 inch, preferably ranges from 0.080 inch to 0.045 inch, and most preferably ranges from 0.075 inch to 0.050 inch.

Figure 2:
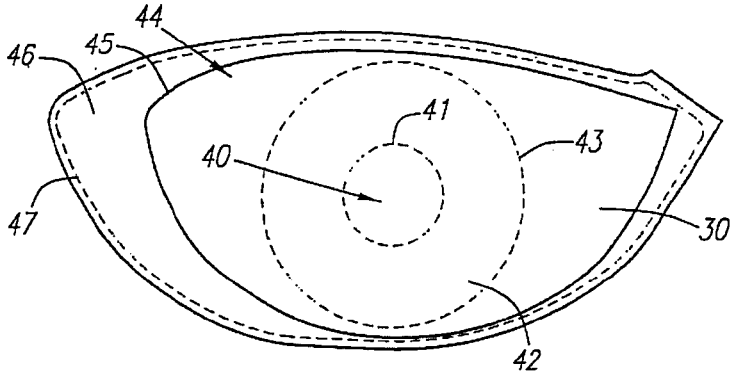
FIG. 2 is a front plan view of the striking plate of FIG. 1 showing the variable face thickness.

In a preferred embodiment, as shown in FIG. 2, the central region has a thickness range of 0.145 inch to 0.090 inch, the transition region 42 has a thickness range of 0.140 inch to 0.080 inch, the first peripheral region 44 has a thickness range of 0.105 inch to 0.090 inch, and the second peripheral region 46 has a thickness range of 0.075 inch to 0.050 inch.

Preferably, as shown in FIG. 2, the central region 40 is 5% to 15% of the surface area of the core face 49 of the striking plate 30. The core face 49 is defined as the central region 40, the transition region 42 and the first peripheral region 44. The core face area of the striking plate 30 has an area between 4.80 square inches and 5.50 square inches, preferably between 5.10 square inches and 5.40 square inches, and most preferably 5.38 square inches. The transition region 42 is preferably 35% to 50% of the surface area of the core face 49, and the first peripheral region 44 is preferably 40% to 55% of the surface area of the core face 49. In a preferred embodiment, the central region is 8.8% of the surface area of the core face 49, the transition region is 42.2% of the surface area of the core face 49, and the first peripheral region 44 is 50% of the surface area of the core face 49.

Figure 7:
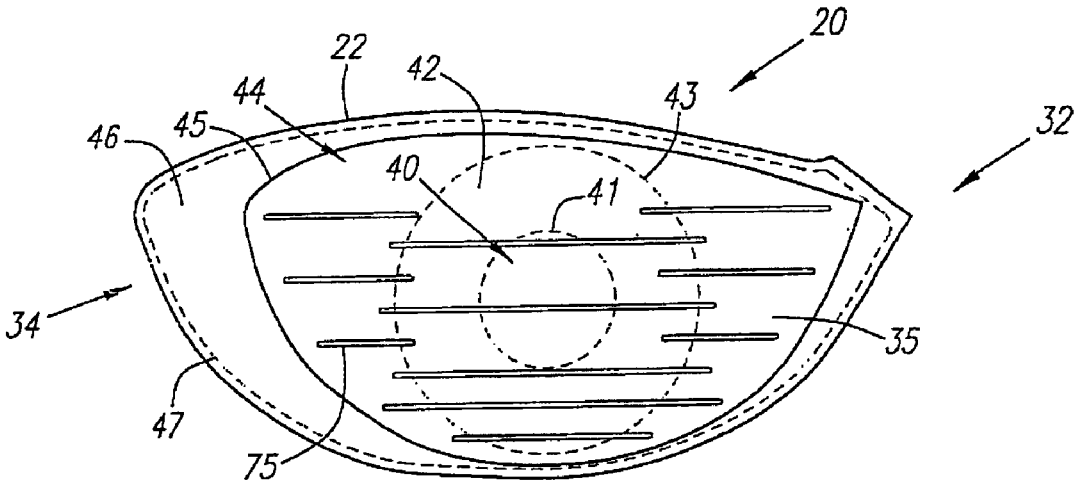
FIG. 7 is a front plan view of a fairway wood golf club head of the present invention with the variable thickness superimposed thereon.
Figure 8:
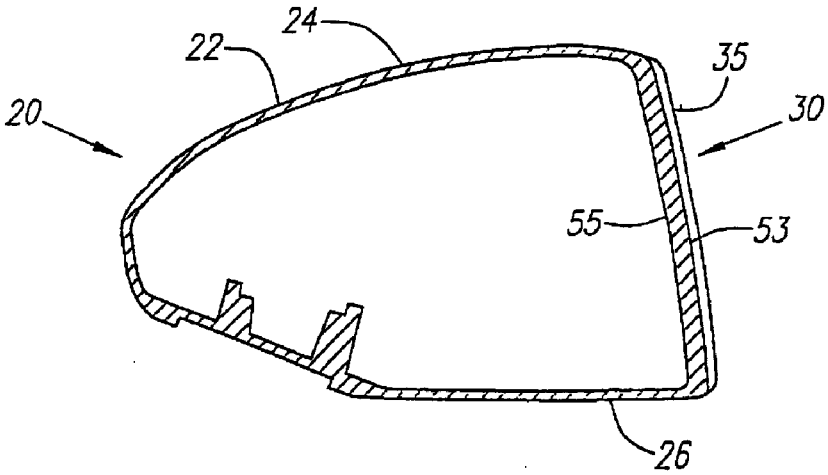
FIG. 8 is a cross-sectional view along lines 8—8 of FIG. 5.

FIG. 7 illustrates an alternative embodiment of the present invention for a fairway wood golf club head 20. In this embodiment, the central region has a thickness range of 0.135 inch to 0.125 inch, the transition region 42 has a thickness range of 0.130 inch to 0.090 inch, the first peripheral region 44 has a thickness range of 0.095 inch to 0.085 inch, and the second peripheral region 46 has a thickness range of 0.075 inch to 0.045 inch.

Table One sets forth the thickness ranges of the central region 40, the first peripheral region 44 and the second peripheral region 46 for preferred embodiments for drivers (lofts 7 degrees through 12 degrees) and fairway woods (2 wood through 9 wood).

TABLE One

| | Striking Plate Thickness | | |
|---|---|---|---|
| Club | Second Peripheral Region | First Peripheral Region | Center Region |
| 07° Driver | .050 ± .005 | .100 ± .005 | .140 ± .005 |
| 08° Driver | .050 ± .005 | .100 ± .005 | .140 ± .005 |
| 09° Driver | .050 ± .005 | .100 ± .005 | .140 ± .005 |
| 10° Driver | .050 ± .005 | .100 ± .005 | .140 ± .005 |
| 11° Driver | .050 ± .005 | .100 ± .005 | .140 ± .005 |
| 12° Driver | .050 ± .005 | .100 ± .005 | .140 ± .005 |
| 2 Wood | .050 ± .005 | .090 ± .005 | .130 ± .005 |
| 3 Wood | .055 ± .005 | .090 ± .005 | .130 ± .005 |
| Strong 3 | .060 ± .005 | .090 ± .005 | .130 ± .005 |
| 4 Wood | .060 ± .005 | .085 ± .005 | .125 ± .005 |
| Strong 4 | .065 ± .005 | .090 ± .005 | .130 ± .005 |
| 5 Wood | .065 ± .005 | .085 ± .005 | .125 ± .005 |
| 7 Wood | .070 ± .005 | .085 ± .005 | .125 ± .005 |
| 9 Wood | .075 ± .005 | .085 ± .005 | .125 ± .005 |

Figure 2A:
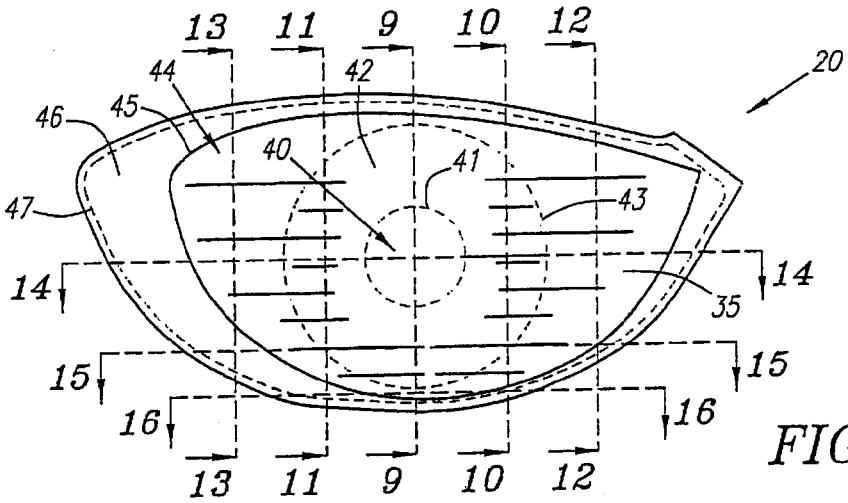
FIG. 2A is a front plan view of the golf club head of FIG. 1 with the variable face thickness pattern superimposed thereon.

Cross-sections of the striking plate 30, taken from FIG. 2A, are illustrated in FIGS. 9–16. The striking plate 30 has variable thickness, with the thickest portion in the center. The thin layer 35 has a uniform overall thickness.

Figure 9:
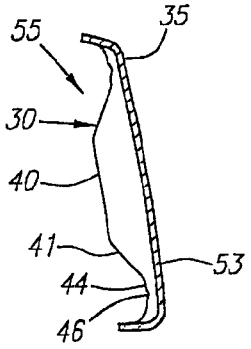
FIG. 9 is a cross-sectional view along lines 9—9 of FIG. 2A.
Figure 10:
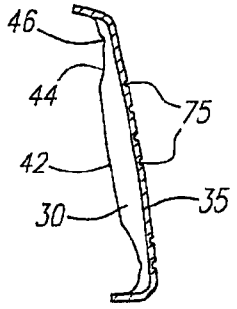
FIG. 10 is a cross-sectional view along lines 10—10 of FIG. 2A.
Figure 11:
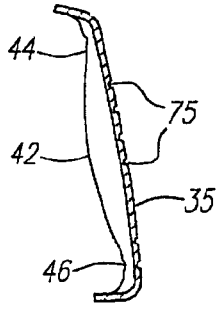
FIG. 11 is a cross-sectional view along lines 11—11 of FIG. 2A.
Figure 12:
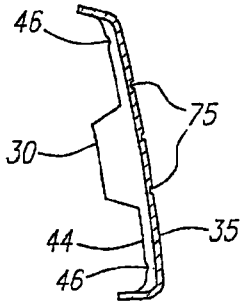
FIG. 12 is a cross-sectional view along lines 12—12 of FIG. 2A.
Figure 13:
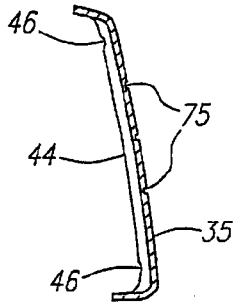
FIG. 13 is a cross-sectional view along lines 13—13 of FIG. 2A.

FIG. 9 illustrates a vertical cross-section of the mid-section of the striking plate 30 with the central region 40, the transition region 42, the first peripheral region 44 and the second peripheral region 46 on the contoured interior surface 55. FIGS. 10 and 11 illustrate vertical cross-sections that are adjacent both sides of the mid-section, and which only includes the transition region 42, the first peripheral region 44 and the second peripheral region 46. FIG. 12 illustrates a vertical cross-section on the heel end 32 of the striking plate 30 that has a wall of the internal hosel 36 integrated therewith in a preferred embodiment. FIG. 12 otherwise shows the first peripheral region 44 and the second peripheral region 46. Although the wall of the internal hosel 36 is shown as integrated with the striking plate 30, alternative embodiments have the internal hosel off-set from the interior surface 55 of the striking plate 30. FIG. 13 illustrates a vertical cross-section of the toe end 34 of the striking plate 30, which only includes the first peripheral region 44 and the second peripheral region 46.

Figure 14:
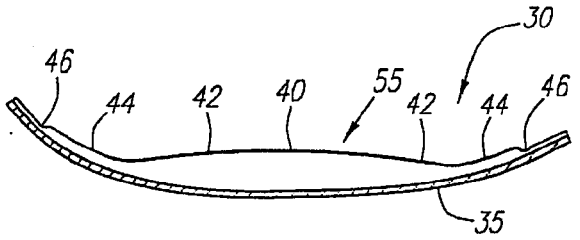
FIG. 14 is a cross-sectional view along lines 14—14 of FIG. 2A.

FIG. 14 illustrates a horizontal cross-section of the horizontal mid-section of the striking plate 30, which shows the central region 40, the transition region 42, the first peripheral region 44, the second peripheral region 46, and the wall of the internal hosel 36.

Figure 15:
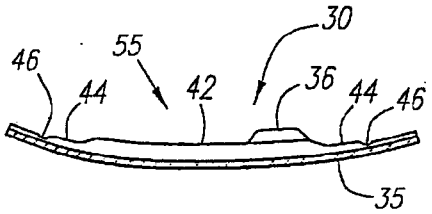
FIG. 15 is a cross-sectional view along lines 15—15 of FIG. 2A.
Figure 16:
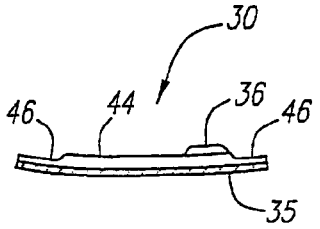
FIG. 16 is a cross-sectional view along lines 16—16 of FIG. 2A.

FIG. 15 illustrates a horizontal cross-section below the horizontal mid-section of the striking plate 30, which only includes the transition region 42, the first peripheral region 44, the second peripheral region 46, and the wall of the internal hosel 36. FIG. 16 illustrates a horizontal cross-section further below the horizontal mid-section of the striking plate 30, which only includes the first peripheral region 44, the second peripheral region 46, and the wall of the internal hosel 36.

The striking plate 30 does not have scorelines. The plurality of scorelines 75 are disposed on the thin layer 35. The scorelines 75 may be traditional indentations having a depth of from 0.001 inch to 0.025 inch, more preferably from 0.003 inch to 0.010 inch, and most preferably 0.005 inch. The contour of each of the scorelines 75 may be as described in U.S. Pat. No. 6,443,856, filed on Nov. 1, 1999, entitled Contoured Scorelines For The Face Of A Golf Club, and incorporated by reference in its entirety. Alternatively, the scorelines may be projections 75*a* such as illustrated in FIG. 3B. Such scoreline projections 75*a* preferably extend 0.003 inch to 0.010 inch from the surface 39 of the tin layer 35.

Figure 17:
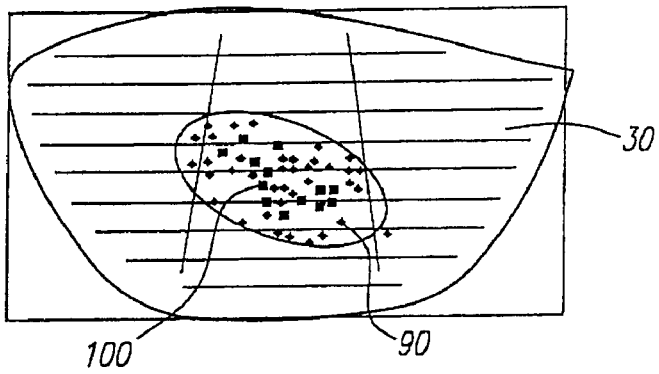
FIG. 17 is an illustration of impact probabilities for high handicap golfers.
Figure 18:
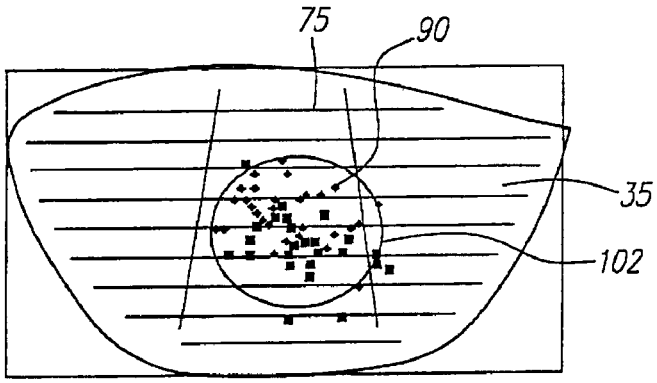
FIG. 18 is an illustration of impact probabilities for low handicap golfers.
Figure 19:
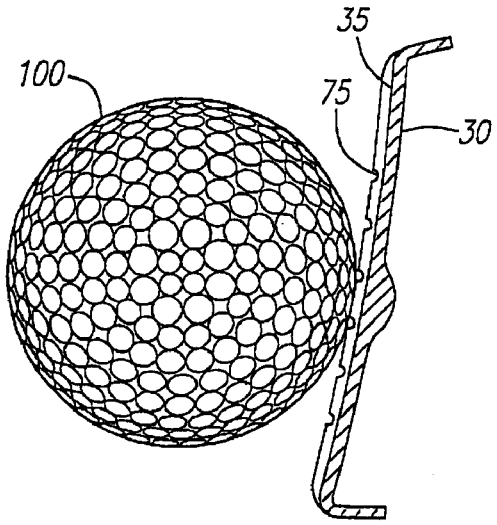
FIG. 19 is a side view of a golf ball impacting the golf club head of the present invention.

As mentioned previously, the thickness of the regions 40, 42, 44 and 46, and for the most part, the thickness of the striking plate 30, corresponds to impact probability. FIGS. 17 and 18 illustrate the impact points during a golf swing for high handicap players and low handicap players, respectively. As shown in FIG. 17, the high handicap players had impacts 90 within an elliptical area 100 that extended through the center of the striking plate 30. In comparison, low handicap players had impacts 90 that were more concentrated and within a circular area 102 of the striking plate 30. These impacts 90 illustrate the points on a striking plate 30 that have the highest probability of undergoing the greatest stress during impact with a golf ball. Therefore, these points require greater thickness than other areas of the striking plate 30. Thus, the regions 40, 42, 44 and 46 correlate to this impact probability in order to design a striking plate with greater thickness where it is needed instead of in areas low impact probability. The present invention may be described as being thinner at the heel and toe ends 32 and 34 than the central region 40.

The variation in the thickness of the striking plate 30 also allows for the greatest thickness of regions 40, 42, 44 and 46 to be distributed in the center region 40 of the striking plate 30 thereby enhancing the flexibility of the striking plate 30 which corresponds to greater compliance of the striking plate 30 during impact with a golf ball thereby providing for reduced energy loss with allows for greater distance.

The striking plate 30 is preferably composed of a stainless steel. Alternatively, the striking plate 30 is composed of a titanium or titanium-alloy material. In yet an alternative embodiment, the striking plate 30 is composed of a vitreous metal such as iron-boron, nickel-copper, nickel-zirconium, nickel-phosphorous, and the like. Yet in further alternative embodiments, the striking plate 30 is composed of ceramics, composites or other metals.

Figure 3:
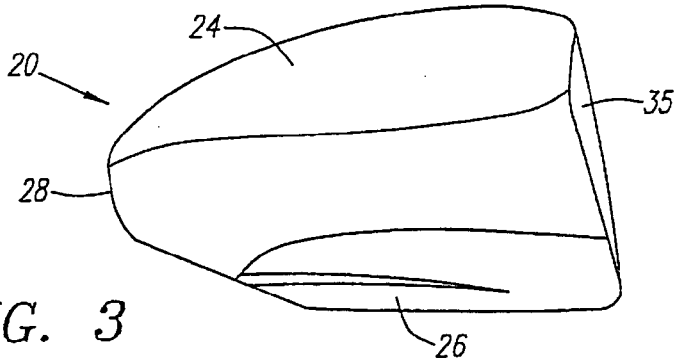
FIG. 3 is a toe side view of the golf club head of FIG. 1.
Figure 3A:
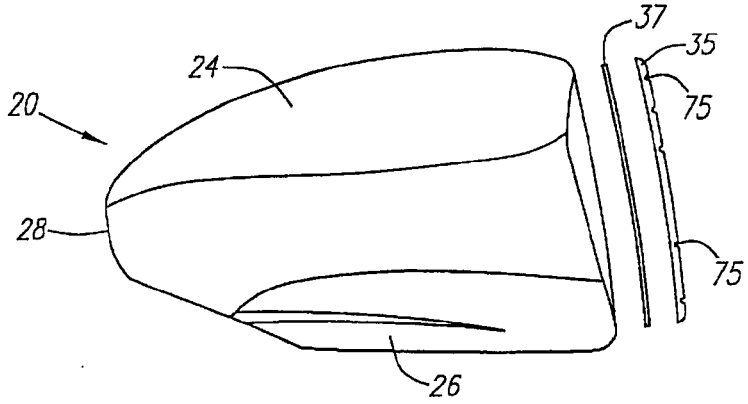
FIG. 3A is a toe side exploded view of the golf club head of the present invention.
Figure 3B:
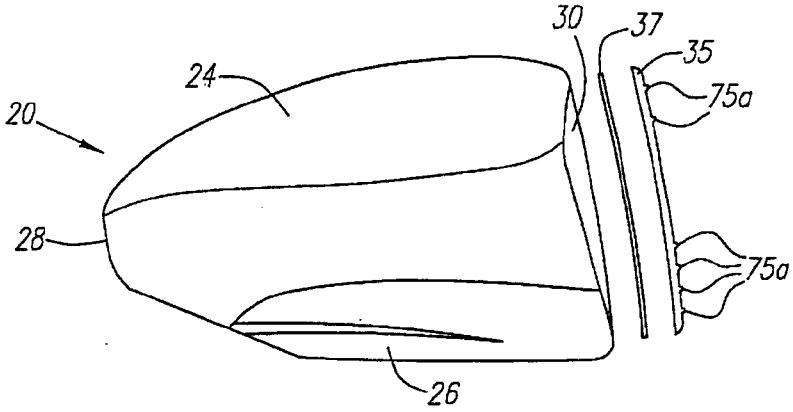
FIG. 3B is a toe side exploded view of an alternative embodiment of the golf club head of the present invention.
Figure 4:
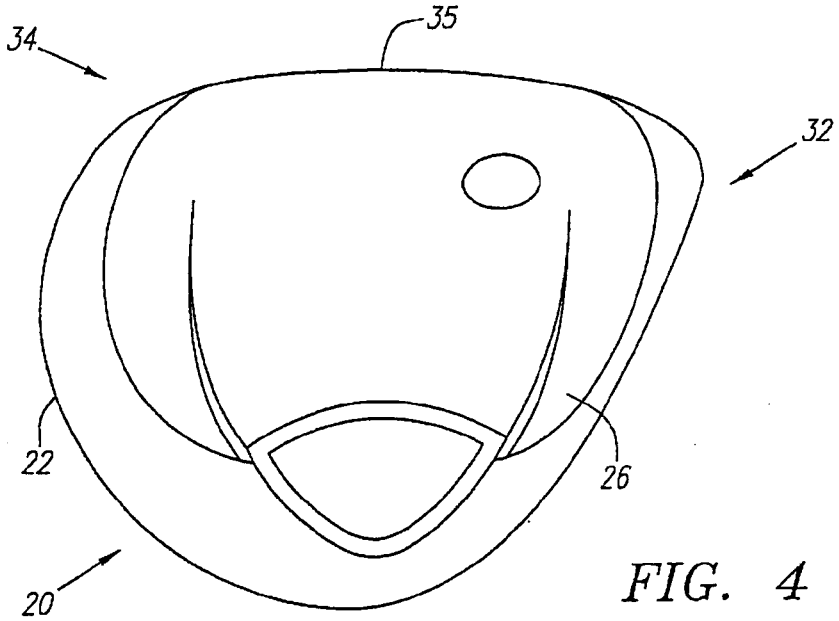
FIG. 4 is a bottom plan view of the golf club head of FIG. 1.
Figure 5:
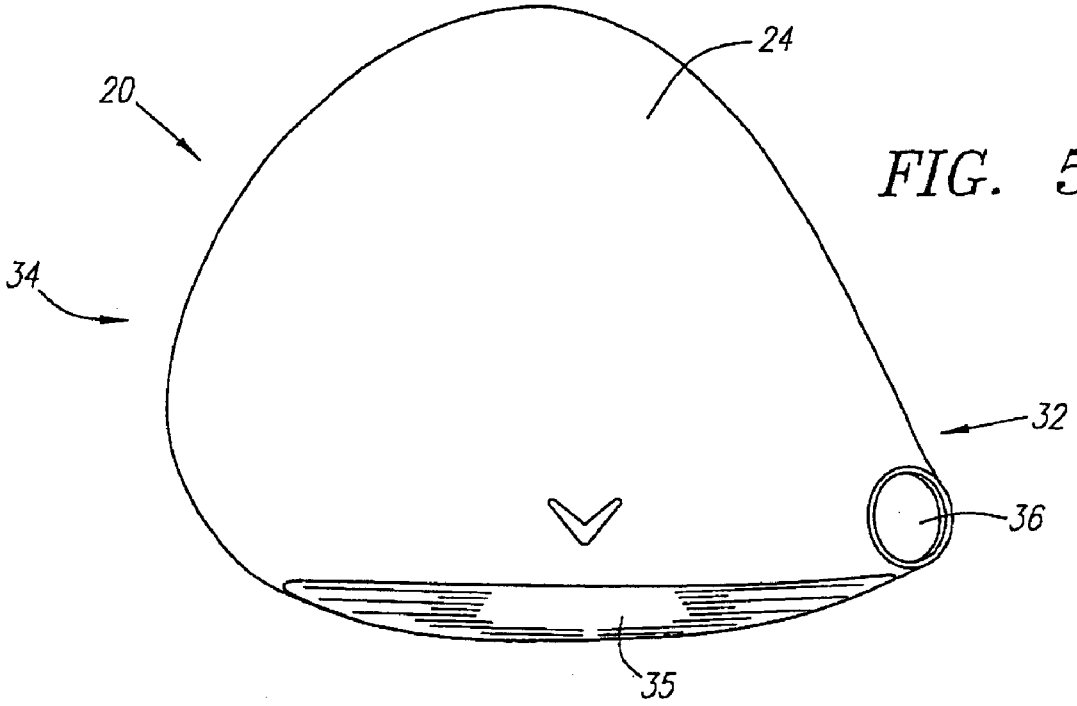
FIG. 5 is a top plan view of the golf club head of FIG. 1.
Figure 6:
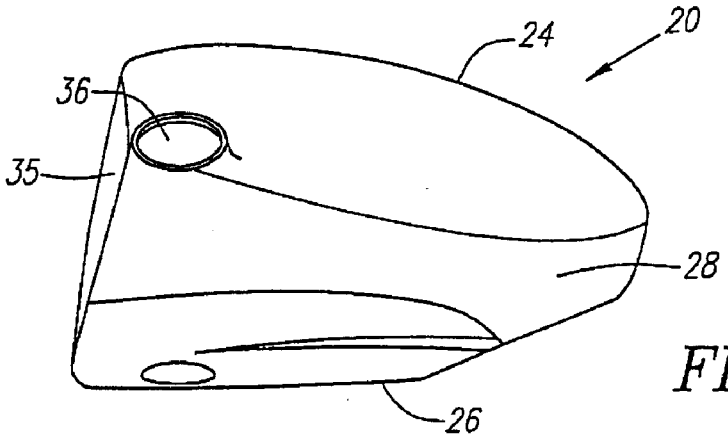
FIG. 6 is a heel side view of the golf club head of FIG. 1.

The thin layer 35 is preferably attached to the exterior surface 55 of the striking plate 30 by an adhesive 37, such as illustrated in FIG. 3A. Other means of attachment include vapor deposition, pressure locking, attachment by screws, and the like.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a body having a crown, a sole, a ribbon, a striking plate and a hollow interior, the body composed of a titanium alloy material, the striking plate having an interior surface toward the hollow interior and a smooth exterior surface opposite the interior surface, the striking plate having a thickness range of 0.010 inch to 0.200 inch, the body having a volume of 250 cubic centimeters to 400 cubic centimeters; and a thin layer disposed on the exterior surface of the striking plate, the thin layer composed of a material having a density lower than the density of the striking plate and selected from the group consisting of polyurethanes, polycarbonates, polyimides and polyamides, the thin layer having a thickness of 0.005 inch to 0.025 inch, the thin layer having a plurality of scorelines thereon.

2. A wood-type golf club head comprising:

a body having a crown, a sole, a ribbon, a striking plate and a hollow interior, the body composed of a titanium alloy material, the striking plate having an interior surface toward the hollow interior and a smooth exterior surface opposite the interior surface, the striking plate having a thickness range of 0.010 inch to 0.200 inch, the striking plate having a core face area between 4.80 square inches and 5.50 square inches, the body having a volume of 250 cubic centimeters to 400 cubic centimeters; and a thin layer disposed on the exterior surface of the striking plate, the thin layer composed of a thermosetting polyurethane material having a density lower than the density of the striking plate, the thin layer having a thickness of 0.005 inch to 0.025 inch, the thin layer having a plurality of scorelines thereon;

wherein the golf club head has a coefficient of restitution of at least 0.83 under USGA test conditions.

3. A wood-type golf club head comprising:

a body having a crown, a sole, a ribbon, a striking plate and a hollow interior, the body composed of a metal material, the striking plate having an interior surface toward the hollow interior and a smooth exterior surface opposite the interior surface, the striking plate having a thickness range of 0.010 inch to 0.200 inch, the striking plate having a core face area between 4.80 square inches and 5.50 square inches, the body having a volume of 250 cubic centimeters to 400 cubic centimeters; and a thin layer disposed on the exterior surface of the striking plate, the thin layer having a central impact region composed of a polyurethane material having a Shore D hardness greater than 50 for low friction and low energy loss, and a peripheral impact region composed of a polyurethane material having a Shore D hardness lower than 40 for a high friction coefficient and a high energy loss, the thin layer having a thickness of 0.005 inch to 0.025 inch, the thin layer having a plurality of scorelines thereon;

wherein the golf club head has a coefficient of restitution of at least 0.83 under USGA test conditions.

* * * * *